US008833571B2

(12) United States Patent
Anderson

(10) Patent No.: US 8,833,571 B2
(45) Date of Patent: Sep. 16, 2014

(54) EYEWEAR DISPLAY AND MODULES FOR SAME

(75) Inventor: William Anderson, Rehoboth, MA (US)

(73) Assignee: FGX International, Inc., Smithfield, RI (US)

( * ) Notice: Subject to any disclaimer, the term of this patent is extended or adjusted under 35 U.S.C. 154(b) by 728 days.

(21) Appl. No.: 13/027,680

(22) Filed: Feb. 15, 2011

(65) Prior Publication Data

US 2012/0205332 A1 Aug. 16, 2012

(51) Int. Cl.
*A47F 7/02* (2006.01)
*A47F 5/00* (2006.01)

(52) U.S. Cl.
CPC ..... *A47F 7/021* (2013.01); *A47F 5/0087* (2013.01)
USPC ..... 211/85.1; 211/126.14; 211/133.3

(58) Field of Classification Search
USPC ..... 211/85.1, 34–37, 87.01, 88.01, 96, 99, 211/104, 113, 116, 126.5, 126.14, 133.3, 211/126.2; 312/248, 213, 328, 327, 229, 312/117, 123, 129, 130, 136, 127; 206/38, 206/235, 574
See application file for complete search history.

(56) References Cited

U.S. PATENT DOCUMENTS 489,593 A * 1/1893 Ramer ..... 312/280
776,332 A * 11/1904 Kloeppinger ..... 211/75
843,826 A * 2/1907 Kloeppinger ..... 211/75
1,560,493 A * 11/1925 Steinberg ..... 211/50
1,763,724 A * 6/1930 Rosenthal ..... 312/218
1,807,611 A * 6/1931 Zapart ..... 232/45
2,240,215 A * 4/1941 Hutchinson ..... 312/73
3,014,597 A 12/1961 Wherter
3,207,566 A * 9/1965 Grieco et al. ..... 312/209
3,241,901 A * 3/1966 Waybright ..... 312/201
3,292,983 A * 12/1966 Service ..... 312/228
3,333,708 A 8/1967 Leblanc et al.
3,333,709 A 8/1967 Leblanc et al.
3,352,614 A * 11/1967 Andersen ..... 312/42
3,869,183 A * 3/1975 Frank, Jr. ..... 312/248
3,924,750 A 12/1975 Dunchock
4,084,700 A 4/1978 Dunchock
4,204,602 A 5/1980 Dunchock
4,609,975 A 9/1986 Badolato et al.
4,903,866 A * 2/1990 Loew ..... 222/129
5,025,931 A 6/1991 Berger
5,101,986 A 4/1992 Holztrager
5,263,578 A * 11/1993 Narvey ..... 206/232
5,370,453 A * 12/1994 Wolff ..... 312/217
5,427,231 A * 6/1995 Willimann ..... 206/38
5,480,039 A * 1/1996 Merl ..... 211/88.01

(Continued)

*Primary Examiner* — Korie H Chan
(74) *Attorney, Agent, or Firm* — Edwards Wildman Palmer LLP; George N. Chaclas

(57) ABSTRACT

An eyewear display including a plurality of pods. Each pod includes a pair of opposing sidewalls, a back wall, and a front wall to form a proximal opening. The front wall defines a plurality of apertures for receiving eyewear support fixtures. A base wall encloses a distal end of the pod to form a storage space for holding eyewear stock accessible by the proximal opening. A mounting mechanism attaches to the back wall by a hinge and has at least one mounting clip for coupling the pod to the display mounting fixture. Each pod is selectively pivotable away from the display mounting fixture to provide access to the storage space for restocking the eyewear display. Preferably, in a display position, the plurality of pods are arranged so that at least one of the proximal openings is at least partially blocked by an adjacent.

17 Claims, 8 Drawing Sheets

(56) References Cited

U.S. PATENT DOCUMENTS

| | | | | |
|---|---|---|---|---|
| 6,039,173 | A | 3/2000 | Crow | |
| 6,227,632 | B1 * | 5/2001 | Liu | 312/223.2 |
| 6,302,369 | B1 | 10/2001 | Liebers et al. | |
| D465,353 | S | 11/2002 | Hessell et al. | |
| 6,631,813 | B1 | 10/2003 | Walter et al. | |
| D486,673 | S | 2/2004 | Hessell | |
| D486,684 | S | 2/2004 | Hessell | |
| D486,982 | S | 2/2004 | Hessell | |
| 7,111,914 | B2 * | 9/2006 | Avendano | 312/405.1 |
| D537,655 | S | 3/2007 | Hessell | |
| 7,784,625 | B2 | 8/2010 | Burgess et al. | |
| 7,900,746 | B2 * | 3/2011 | Fleming | 182/129 |
| 2007/0241071 | A1 | 10/2007 | Antonioni et al. | |
| 2009/0045154 | A1 | 2/2009 | Gerstner | |

* cited by examiner

EYEWEAR DISPLAY AND MODULES FOR SAME

BACKGROUND OF THE DISCLOSURE

1. Field of the Disclosure

The subject disclosure relates to displays for eyewear and like items, and more particularly to an improved module or pod for storing and displaying eyewear.

2. Background of the Related Art

Wall mount displays, isle end unit displays, and stand alone pedestal displays are often used to display eyewear and like items. The displays provide a proper setting to facilitate consumer purchase by also providing such amenities as a mirror in addition to an attractive and accessible presentation. Commonly, stand alone pedestal displays will rotate to allow a large selection to be accessed by a potential consumer.

When the display sells out of an item, a clerk is tasked with replenishing items from a stock room. However, due to a large selection and the other duties that the clerk may have, displays are often poorly restocked. Although the display may present a large number of items, several items may be presented multiple times while other items remain in the stock room and are unavailable for sale. Further, as clerks may not always be able to access the stock room during the day, significant sales of the items can create significant empty areas on the display. Such poor representation of the product line results in reduced sales.

In view of the above, several systems have been developed to present items such as eyewear. Some examples are illustrated in U.S. Pat. No. 3,333,708 issued to Leblanc et al. on Aug. 1, 1967, U.S. Pat. No. 3,333,709 issued to Leblanc et al. on Jul. 28, 1967, U.S. Pat. No. 3,924,750 issued to Dunchock on Dec. 9, 1975, U.S. Pat. No. 4,204,602 issued to Dunchock on May 27, 1980, U.S. Pat. No. 4,609,975 issued to Badolato et al. on Sep. 2, 1986, U.S. Pat. No. 5,101,986 issued to Holztrager on Apr. 7, 1992, and U.S. Pat. No. 7,784,625 issued to Burgess et al. on Aug. 31, 2010.

SUMMARY OF THE INVENTION

There are problems associated with the prior art systems. For example, often the display area is underutilized As retail point of purchase floor space is highly valuable, the displays should maximize the usable display area while facilitating maintaining a full display having each model appropriately placed thereon. There is a need, therefore, for an improved display unit which permits easy refill of the display and aids in assuring proper representation of the full product line without wasting retail floor space or requiring unnecessary remote storage.

In one embodiment, the subject technology is directed to an eyewear display including a display mounting fixture and a plurality of pods adapted and configured to selectively couple to the display mounting fixture. Each pod includes a pair of opposing sidewalls, a back wall extending between the sidewalls, and a front wall extending between the opposing sidewalls to form a proximal opening. The front wall defines a plurality of apertures for receiving eyewear support fixtures. A base wall extends between the opposing sidewalls, the back wall, and the front wall to enclose a distal end of the pod to form a storage space for holding eyewear stock accessible by the proximal opening. A mounting mechanism attaches to the back wall by a hinge and has at least one mounting clip for coupling the pod to the display mounting fixture. Each pod is selectively pivotable away from the display mounting fixture to provide access to the storage space for restocking the eyewear display. Preferably, in a display position, the plurality of pods are arranged so that at least one of the proximal openings is at least partially blocked by an adjacent pod and the eyewear support fixtures are selected from a group consisting of fixtures that present eyeglasses in a substantially horizontal orientation, a substantially vertical orientation, and combinations thereof.

In another embodiment, the subject technology is an eyeglass display including a fixture portion having a plurality of sections. Each section includes a pair of opposing sidewalls, a back wall extending between the sidewalls, and a front wall extending between the opposing sidewalls to form a proximal opening. The front wall defines a plurality of apertures for receiving eyewear support fixtures. A base wall extends between the opposing sidewalls, the back wall, and the front wall to enclose a distal end of the pod to form a storage space for holding eyewear stock accessible by the proximal opening. A mounting mechanism hingedly attaches the back wall to the fixture portion. Each storage space is selectively pivotable away from the fixture portion to provide access to the storage space for restocking the eyewear display.

Still another embodiment is directed to a pod for displaying eyewear including opposing sidewalls, a front wall extending between the opposing sidewalls and forming a plurality of mounting apertures, a back wall extending between the opposing sidewalls and opposing the front wall to form a proximal opening, and a base wall extending between the opposing sidewalls, the front wall and the back wall to enclose a distal end of the pod to form a storage space for holding eyeglasses accessible by the proximal opening. A mounting mechanism operatively connects to the back wall and has a mounting feature for coupling the pod to a fixture. A user can selectively move the storage space from a display position with respect to the mounting mechanism to a restock position by virtue of the mounting mechanism being hingedly attached to the back wall. Preferably, a magnet mounts to the back wall for retaining the mounting mechanism in the display position.

Yet another embodiment is directed to an eyeglass display including a base, an elongated pedestal upstanding from the base along an axis and mounted for rotation about the axis, and a plurality of pods selectively mounted to the elongated pedestal. Each pod includes: a first pair of opposing sidewalls; a second pair of opposing sidewalls extending between the first pair and forming a proximal opening, wherein an inner wall of the second pair is adjacent the elongated pedestal and an outer wall of the second pair forms at least a portion of a periphery of the eyeglass display case, wherein the outer wall defines a plurality of mounting apertures; a base wall extending between the first and second pairs to enclose a distal end of the pod to form a storage space for holding eyeglasses accessible by the proximal opening; and a mounting mechanism attached to the inner wall by a hinge and having a mounting feature for coupling the pod to the elongated pedestal. In a display position, the plurality of pods are adjacent the mounting mechanism so that the proximal opening is at least partially blocked by adjacent pods. In a restock position, each pod is individually pivoted away from the elongated pedestal to provide access to the storage space.

It should be appreciated that the present technology can be implemented and utilized in numerous ways, including without limitation as a display, a unit, a case, a module, a pod, a process, an apparatus, a system, a device, a method for applications now known and later developed and the like. These and other unique features of the system disclosed herein will become more readily apparent from the following description and the accompanying drawings.

BRIEF DESCRIPTION OF THE DRAWINGS

So that those having ordinary skill in the art to which the disclosed system appertains will more readily understand how to make and use the same, reference may be had to the drawings wherein.

DETAILED DESCRIPTION OF PREFERRED EMBODIMENTS

Figure 1:
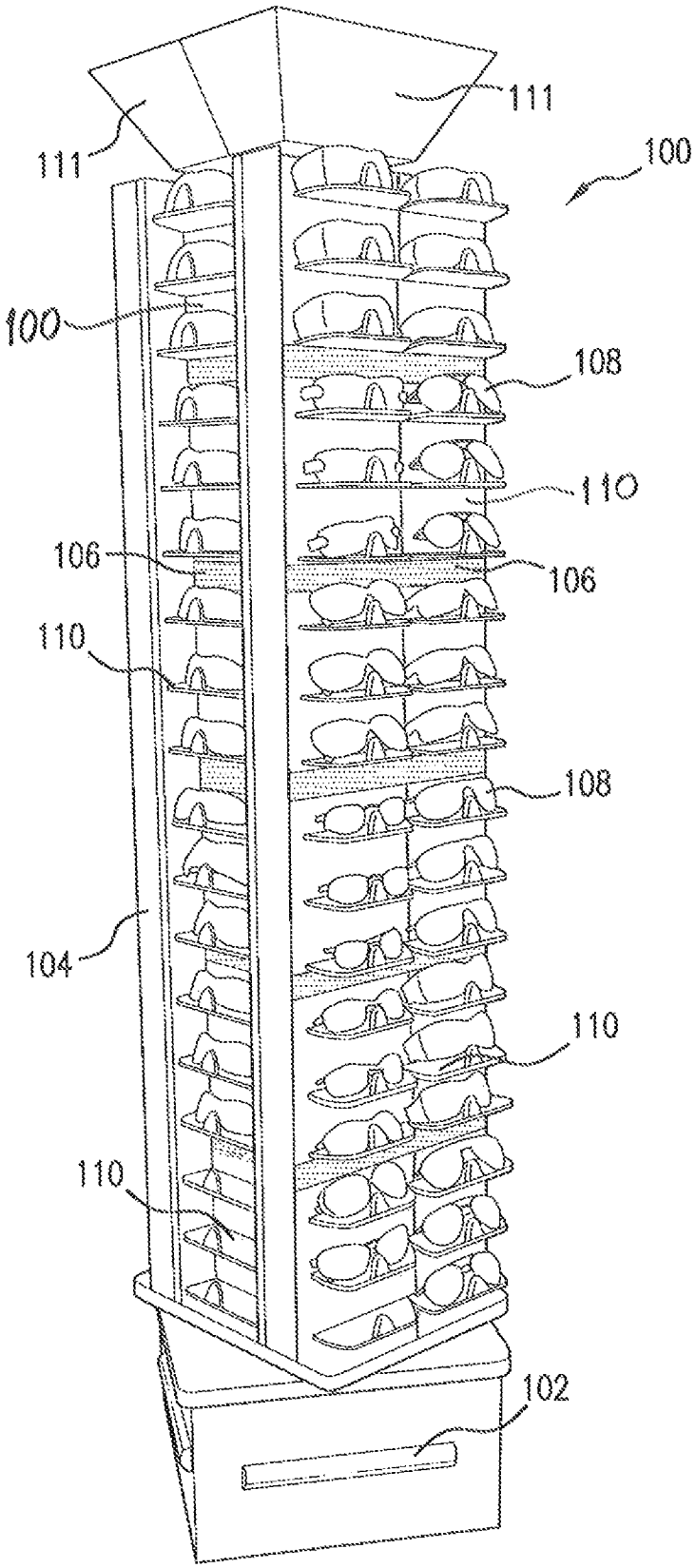
FIG. 1 is a perspective view of a display for eyewear in accordance with the subject technology.

The present disclosure overcomes many of the prior art problems associated with displays for eyewear and related items. The advantages, and other features of the displays and methods disclosed herein, will become more readily apparent to those having ordinary skill in the art from the following detailed description of certain preferred embodiments taken in conjunction with the drawings which set forth representative embodiments of the present invention and wherein like reference numerals identify similar structural elements.

All relative descriptions herein such as vertical, horizontal, front, back, left, right, up, and down are with reference to the Figures, and not meant in a limiting sense. Unless otherwise specified, the illustrated embodiments can be understood as providing exemplary features of varying detail of certain embodiments, and therefore, unless otherwise specified, features, components, modules, elements, and/or aspects of the illustrations can be otherwise resized, combined, interconnected, sequenced, separated, interchanged, positioned, and/or rearranged without materially departing from the disclosed systems or methods. Additionally, the shapes and sizes of components are also exemplary and unless otherwise specified, can be altered without materially affecting or limiting the disclosed technology.

Referring now to FIG. 1, a perspective view of a display for eyewear in accordance with the subject technology is shown and referred to generally by the reference number 100. The display 100 is intended to be used at a point of sale such as in a retail outlet like a pharmacy, news stand, general store, chain store etc. The display 100 is configured to be free standing or stand alone on a stationary base 102. A pedestal 104 extends upward from the base vertically, e.g., along a vertical axis. The pedestal 104 is mounted for rotation about the vertical axis so that potential consumers as well as clerks may rotate each side of the pedestal 104 without moving.

The pedestal 104 has four sides 106 although only two are seen in FIG. 1. One illustrated side 106 is configured to display a single column of eyewear 108 whereas the other side 106 supports two columns of eyewear 108. The unseen opposite sides 106 are similarly configured. It is envisioned that the pedestal 104 could be of any configuration such as three, four, five sided etc. and each side could have any number of columns or rows as is practical or desired for any particular application. As shown, the pedestal 106 includes a fixture portion (not shown explicitly) for receiving a plurality of pods 110. The display 100 also includes one or more minors 111. In addition to or instead of minors 111, the display 100 could also include advertising such as a company name and/or a plurality of trademarks.

Still referring to FIG. 1, each pod 110 is adapted and configured to present three pieces of eyewear 108 in a horizontal orientation as well as store a plurality of stock items such as additional eyewear. By appropriately maintaining matching stock in each pod 110, as eyewear 108 is purchased, the same or alternative preselected designs of eyewear can be quickly and easily presented for display by the clerk without having to venture into a separate stock room and ignore the clerk's other duties such as maintaining a presence on the retail floor. It is envisioned that the pods 110 may display any number of pieces of eyewear and store varying amounts of same. The pods 110 may also be configured to display and store other items such as eyewear straps, eyewear cases and like items in addition to or instead of eyeglasses. By having the relevant replacement items stored in the pods 110, each pod 110 is easily maintained full of the correct item, thereby alleviating over and under representation of the various models to be presented.

Figure 2:
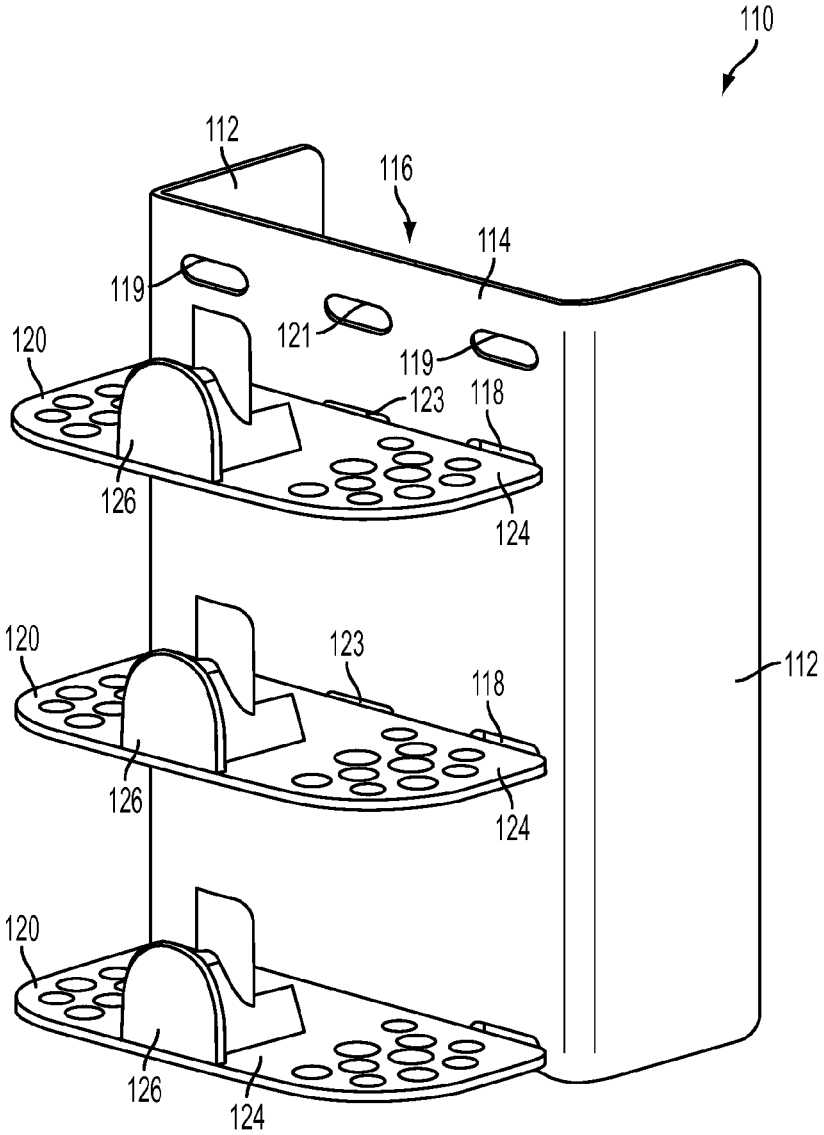
FIG. 2 is a perspective front view of a pod for use on the display of FIG. 1 in accordance with the subject technology.
Figure 3:
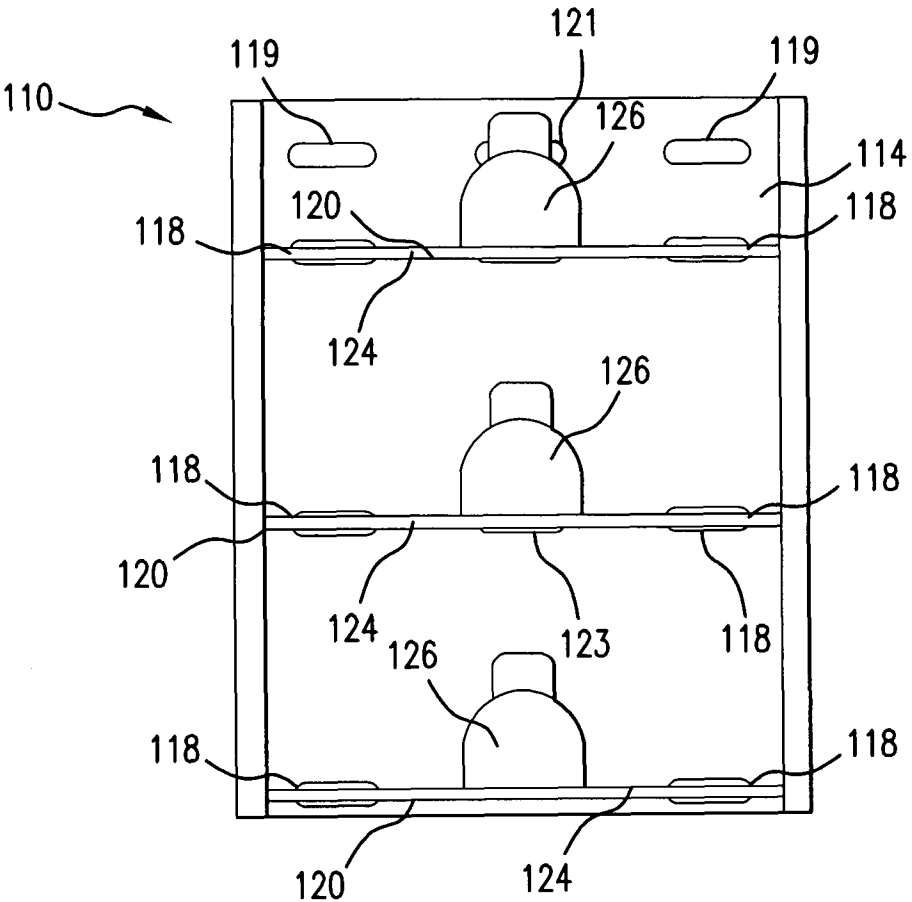
FIG. 3 is a front view of the pod of FIG. 1.
Figure 4:
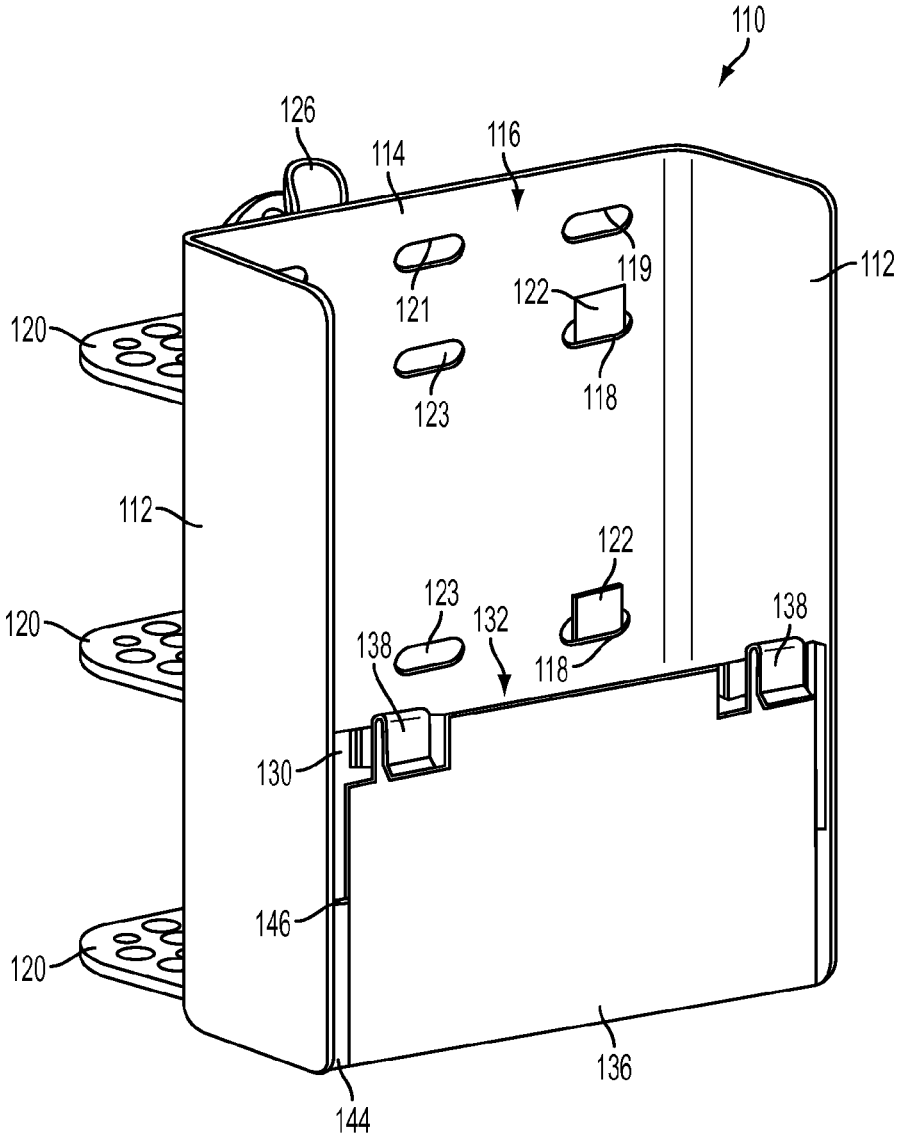
FIG. 4 is a rear perspective view of the pod of FIG. 1.

Referring now to FIGS. 2-4, perspective, front, and back perspective views of a pod 110 for use on the display 100 of FIG. 1 are shown. The pod 110 has a pair of opposing sidewalls 112 with a front wall 114 extending there between to form a proximal opening 116. The front wall 114 defines a plurality of apertures 118, 119, 121, 123 for receiving eyewear support fixtures 120. In the configuration of FIGS. 2-4, only the apertures 118 are utilized. The apertures 118 are formed in three rows of two each for coupling to insertion tabs 122 on the fixtures 120. Each fixture 120 has a platform 124 extending from the tabs 122. A simulated nosepiece 126 on the platform 124 provides a rest for the bridge of the eyewear 108 so that the eyewear 108 is displayed in an aesthetic horizontal manner. Preferably, the eyewear support fixtures 120 are fabricated from a clear material. It is envisioned that the aperture configuration in the front wall 114 and support fixtures could vary to accommodate any type of eyewear with and without associated hanging tags (vertical or horizontal). For example, the apertures 119, 121 could be used to display lengthy items or short items with a second row of short items hanging from fixtures in apertures 118, 123. Similarly, a single fixture could mount in any of the apertures and branch in varying configurations to display a single item or plurality of items.

Figure 5:
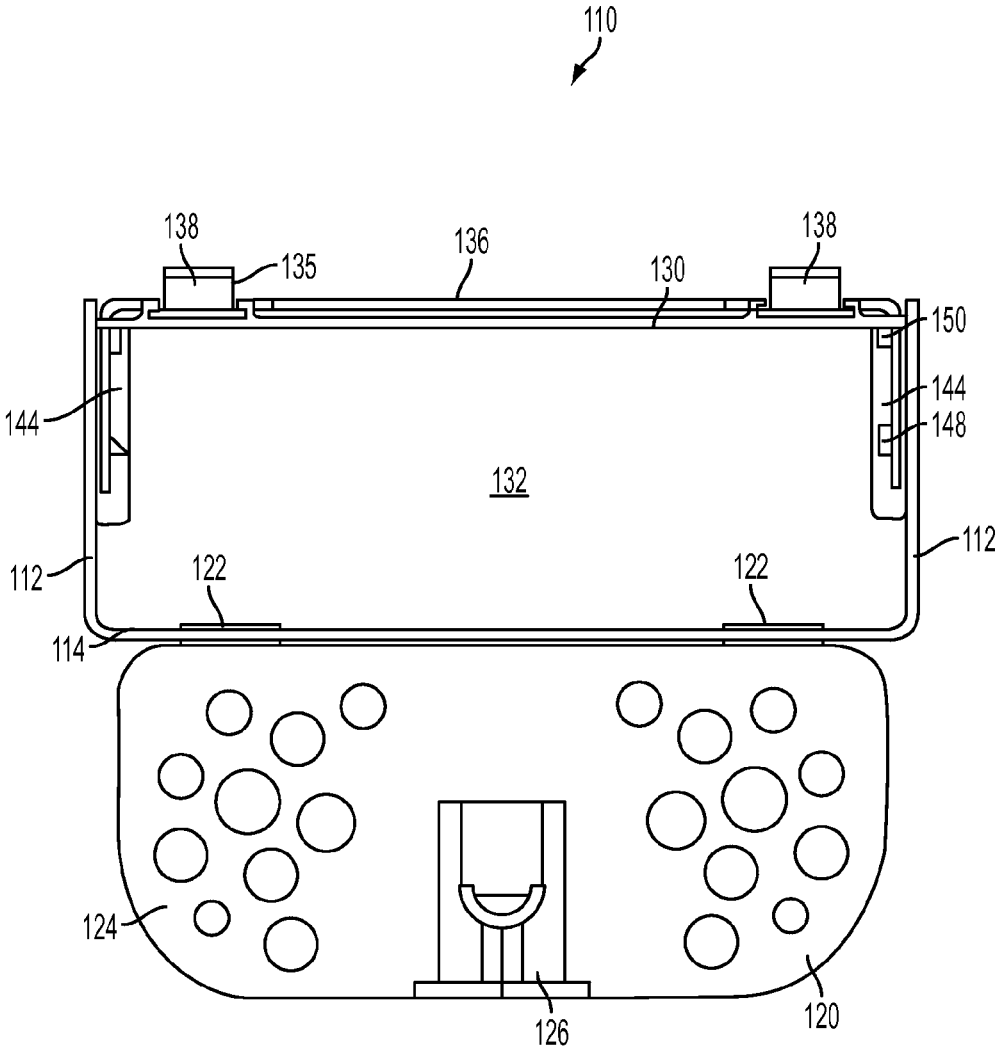
FIG. 5 is a top view of the pod of FIG. 1.

Referring additionally to FIG. 5, which is a top view of the pod 110, a back wall 130 (best seen in FIGS. 4-7) extends between the sidewalls 112. The back wall 130 is relatively shorter than the front wall 114 to allow easy access to the pod interior storage space 132 via the proximal opening 116.

The pod 110 also includes a base wall 134 opposing the proximal opening 116 to partially enclose the storage space 132. A mounting mechanism 135 allows coupling the pod 110 to the display fixture portion and selectively allowing access to the storage space 132. The mounting mechanism 135 includes a mounting panel 136 hingedly attached to the back wall 130. The back wall 130 is sufficiently recessed into the storage space 132 so that the mounting panel 136 is relatively flush with the sidewalls 112.

Figure 7:
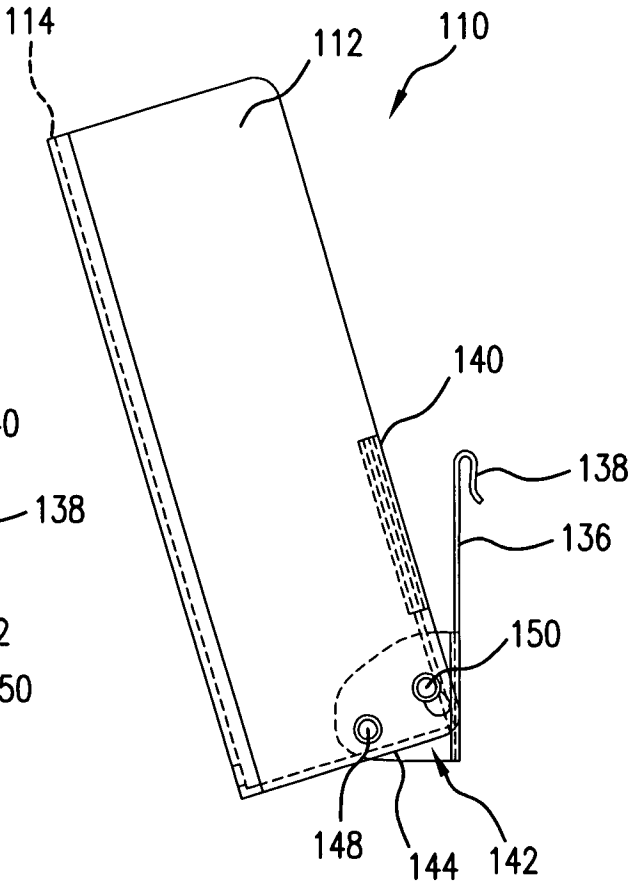
FIG. 7 is a side view of the pod of FIG. 1 in a restock position.
Figure 6:
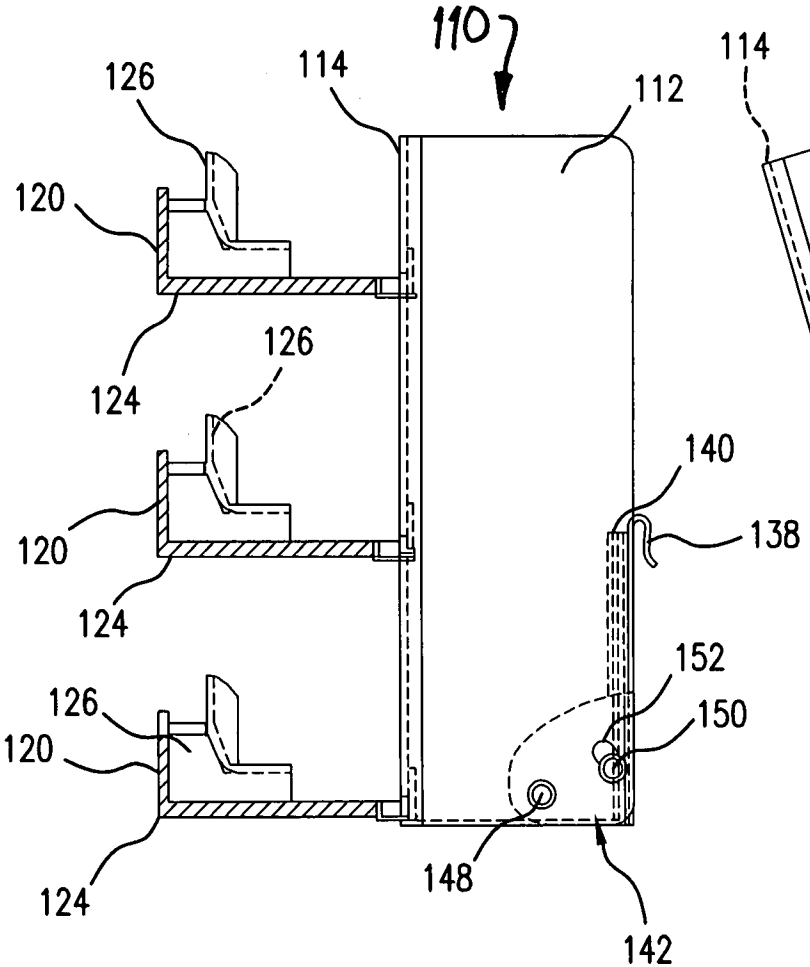
FIG. 6 is a side view of the pod of FIG. 1 in a display position.

Referring now to FIGS. 6 and 7, side views of the pod 110 are shown in a display position and a restock position, respectively. The mounting panel 136 is normally substantially flush to the back wall 130, i.e., the display position. The mounting mechanism 135 also includes clips 138 on the top of the mounting panel 136 for coupling to the display fixture portion. The mounting mechanism and display fixture portion can be any of numerous configurations as would be appreciated by those of ordinary skill in the pertinent art based upon review of the subject technology. For example, the display fixture portion could be a plurality of horizontal parallel rails or T-shaped rails that simply allow the clips 138 to hang in place. Without limitations, the mounting mechanism and display fixture portion could accomplish the desired function by employing hook and loop fabric, adhesives (temporary and/or permanent), screws, bolts, tape, magnets, rivets, fasteners, combinations thereof and the like now known and later developed.

In one embodiment, the mounting panel 136 is fabricated from metal so that a magnet 140 fixed to the back wall 130 maintains the mounting panel 136 in the display position. The majority of the pod 110 is fabricated from polycarbonate such as the sidewalls 112, the front wall 114 and back wall 130. A hinge mechanism 142 at the bottom of the pod 110 allows the storage space 132 to simply be pulled away from the mounting panel 136 by overcoming the retentive force of the magnet 140.

The hinge mechanism 142 includes opposing tabs 144 extending through slots 146 formed in the back wall 130 adjacent the sidewalls 112. Pairs of pins 148, 150 extending from the sidewalls 112 provide pivot points (pins 148). Slotted holes 152 in the tabs 144 receive the pins 150 such that the arc of the slotted holes 152 determines the range of travel from the display position to the restocking position. When the pod 110 is pivoted away from the mounting panel 136, the clerk has access to the storage space 132 for restocking the eyewear display. To return the pod 110 to the display position, one simply pushes the front wall 114 so that the magnet 140 again retains the pod 110 in the display position.

Various technology may be used to create a satisfactory hinge mechanism 142. For example, the pins 148, 150 may be integrally formed with the sidewalls 112 or subsequently added. The slots 146 may serve double duty as retaining the tabs 144 or, as shown in FIG. 5, the pins 148, 150 may have heads that retain the tabs 144. In another embodiment, bolt assemblies extend through holes in the sidewalls 112 and the tabs 144 to form the pivot points and limit the travel for the hinge mechanism 142.

Referring again to FIG. 1, it can be seen that the pods 110 are positioned so that the proximal openings 116 are at least partially blocked by the pod 110 above. As a result, the vertical display area efficiently and aesthetically presents a large volume of eyewear 108. However, by moving a pod 110 into the restocking position, the respective eyewear support fixtures 120 can be easily filled with eyewear 108 when empty.

In one embodiment, the pod 110 is about 8.25 inches high and 6.5 inches wide. The vertical spacing between the rows of apertures 118 is about 3.125 inches with the apertures being about 1.0 by 0.25 inch. The horizontal spacing between the apertures 118, 121 is about 2.13 inches. The storage space 132 is about 2.656 inches deep and the eyewear support fixtures 120 extend about 2.75 inches from the front wall 114. The distance between the clips 138 is about 4.75 inches. The slot 152 is sized so that the storage space 132 tilts forward about sixteen degrees from vertical in the restocking position.

The pods 110 can also be used on any type of display fixture or arrangement. In other words, the pods 110 can be part of a modular system consisting of a plurality of pods and a plurality of matching display fixture portions. The coupling mechanism between the pods and display fixture portions, and other various components such as the hinge mechanism, can be varied as would be appreciated by those of ordinary skill in the pertinent art. By providing modular components, the pods 110 may be utilized in a variety of display formats such as components on a very large wall or isle having display fixtures thereon but with only a certain area having pods 110, which may be increased or decreased as desired.

Figure 8:
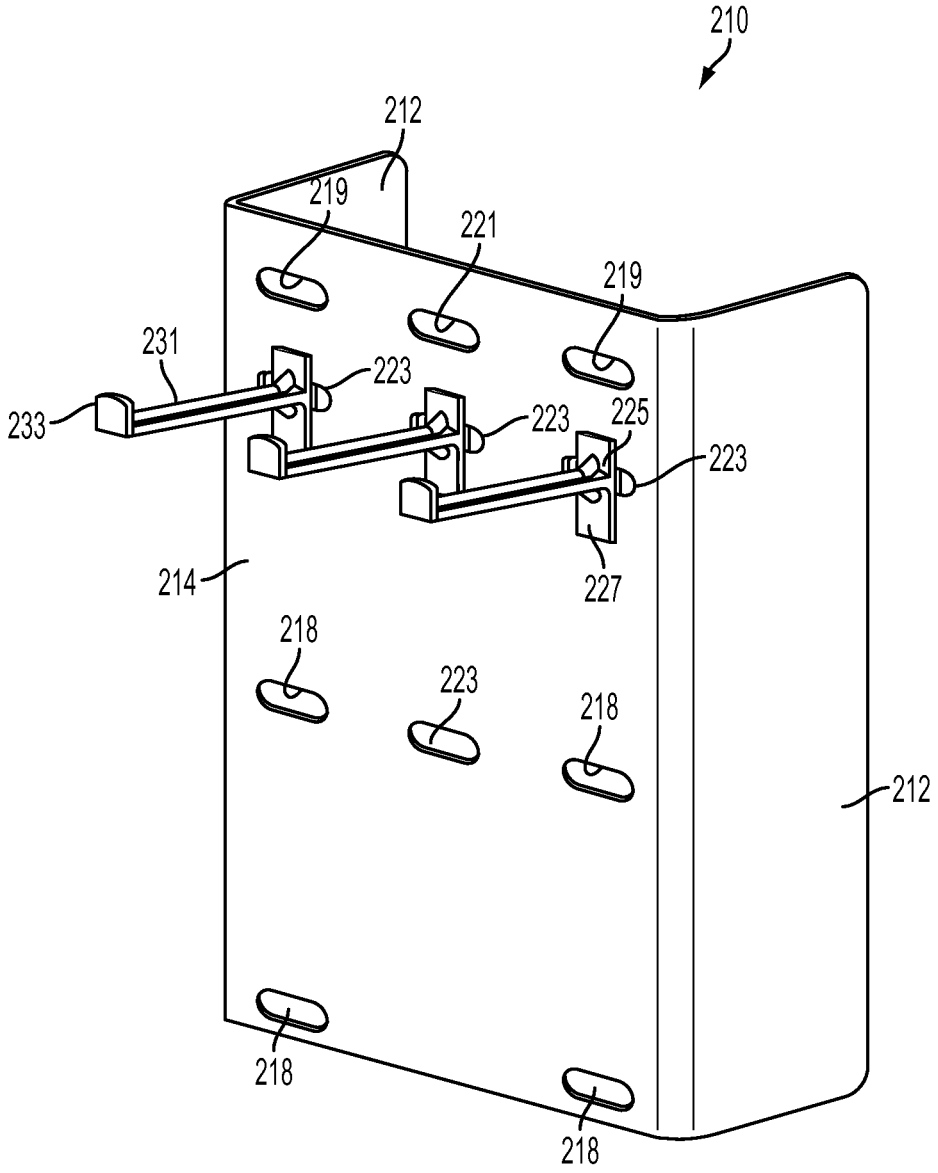
FIG. 8 is a perspective front view of another pod for use on the display of FIG. 1 in accordance with the subject technology.
Figure 9:
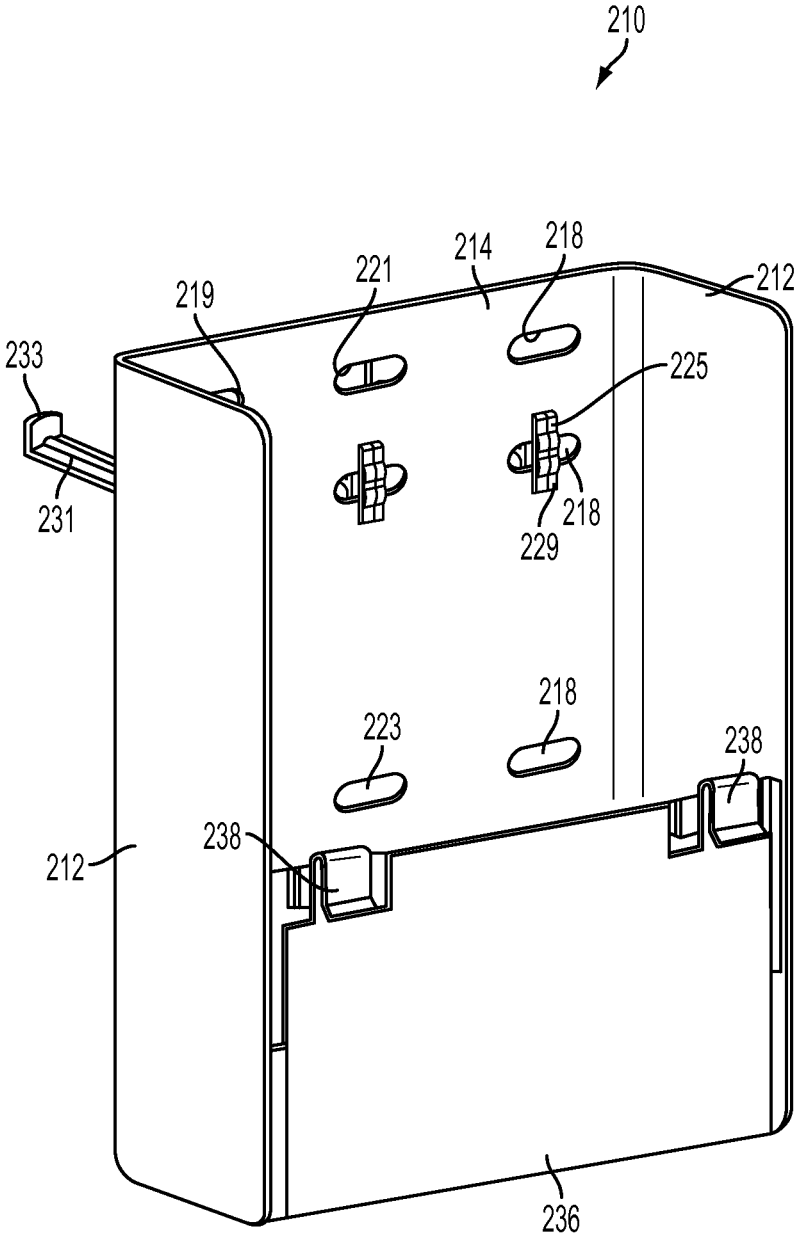
FIG. 9 is a rear perspective view of the pod of FIG. 8.

Referring now FIGS. 8 and 9, perspective front and rear views, respectively, of another pod 210 for use on the display of FIG. 1 or the like is shown. As will be appreciated by those of ordinary skill in the pertinent art, the pod 210 utilizes similar principles to the pod 110 described above. Accordingly, like reference numerals preceded by the numeral "2" instead of the numeral "1", are used to indicate like elements. The primary difference of the pod 210 in comparison to the pod 110 is the eyewear support fixture 220 is configured to present eyewear (not shown) vertically from a hang tag (not shown). Such hang tags are well known, see for example, U.S. patent application Ser. No. 12/133,208 filed on Jun. 4, 2008 entitled Double Bridged Tag.

The front wall 214 forms the same apertures as in the pod 110 described above. It can be seen that a top row of apertures 219, 221 allows inserting the eyewear support fixtures 220 at a higher level. This arrangement could accommodate relatively longer eyewear. Alternatively, the top row of apertures 219, 221 could be utilized to hold relatively short items in a vertical orientation with additional eyewear support fixtures 220 being placed in the middle row of apertures 218, 223 for holding additional items in a vertical orientation. Also, hanging tags could be utilized to display eyeglasses in a horizontal orientation from an eyewear support fixture 220. Of course, one could also utilize combinations of the eyewear support fixtures 120, 220 on the same pod 110, 210 to arrive at a desired configuration.

The eyewear support fixtures 220 include a twist-lock mechanism 225, which is substantially an annular channel (not explicitly shown) formed between front and rear flanges 227, 229. The twist-lock mechanism 225 is also easily coupled to the front wall 214. To make the connection, the rear flange 229 is inserted in the respective aperture 218, 219, 221, 223 and rotated ninety degrees. The eyewear support fixtures 220 include a post 231 with a turned end 233 for improved retention of the eyewear thereon. Preferably, the eyewear support fixtures 220 are fabricated from a clear material. In alternative embodiments, the coupling mechanism 225 and the front wall apertures 118, 119, 123, 218, 219, 221 are varied as needed to accept coupling mechanisms of the eyewear support fixtures 120, 220.

In one embodiment, the pod 210 is about 8.25 inches high and 6.5 inches wide. The vertical spacing between the rows of apertures 218 is about 3.125 inches with the apertures being about 1.0 by 0.25 inch. The horizontal spacing between the apertures 218, 221 is about 2.13 inches. The storage space 232 is about 2.656 inches deep and the eyewear support fixtures 220 extend about 2.5 inches from the front wall 214. The distance between the clips 238 is about 4.75 inches. The slot 252 is sized so that the storage space 232 tilts forward about sixteen degrees from vertical in the restocking position. The twist-lock mechanism 225 is also configured so that the post 231 forms about an eighty-seven degree angle with the front wall 214 so that eyewear thereon will be slightly biased towards the front wall 214.

As would be appreciated by those of ordinary skill in the pertinent art, the subject technology is applicable to use as display for eyewear (or other small items) with significant advantages for high volume, limited space applications. The functions of several elements may, in alternative embodiments, be carried out by fewer elements, or a single element.

Similarly, in some embodiments, any functional element may perform fewer, or different, functions than those described with respect to the illustrated embodiment. Materials and substitutions now known and later developed may also be made such as using netting, straps, bands, vented walls, slatted walls and the like instead of the configurations shown. Also, functional elements (e.g., hinges, eyewear support fixtures and the like) shown as distinct for purposes of illustration may be incorporated within other functional elements, separated in different hardware or distributed in various ways in a particular implementation. Further, relative size and location are merely somewhat schematic and it is understood that not only the same but many other embodiments could have varying depictions.

INCORPORATION BY REFERENCE

All patents, patent applications and other references disclosed herein are hereby expressly incorporated in their entireties by reference.

While the invention has been described with respect to preferred embodiments, those skilled in the art will readily appreciate that various changes and/or modifications can be made to the invention without departing from the spirit or scope of the invention as defined by the appended claims. For example, each claim may depend from any or all claims in a multiple dependent manner even though such has not been originally claimed.

What is claimed is:

1. An eyewear display comprising:

a) a display mounting fixture;

b) a plurality of pods adapted and configured to selectively couple to the display mounting fixture, each pod including:

i) a pair of opposing sidewalls;

ii) a back wall extending between the sidewalls;

iii) a front wall extending between the opposing sidewalls to form a proximal opening, wherein the front wall defines at least one aperture for receiving an eyewear support fixture;

iv) a base wall extending between the opposing sidewalls, the back wall, and the front wall to enclose a distal end of the pod to form a storage space for holding eyewear stock accessible by the proximal opening; and v) a mounting mechanism attached to the back wall by a hinge and having at least one mounting fastener for selectively coupling the pod to the display mounting fixture, wherein each pod is selectively pivotable away from the display mounting fixture to provide access to the storage space for restocking the eyewear display and, in a display position, the plurality of pods are arranged so that at least one of the proximal openings is at least partially blocked by an adjacent pod so that a maximum number of eyeglasses may be displayed.

2. An eyewear display as recited in claim 1, wherein the display mounting fixture is a base and an elongated pedestal upstanding from the base and mounted for rotation thereon.

3. An eyewear display as recited in claim 1, wherein the display mounting fixture is a panel for mounting on a wall of an isle structure or building.

4. An eyewear display as recited in claim 1, wherein the eyewear support fixtures are selected from a group consisting of fixtures that present eyeglasses in a substantially horizontal orientation, a substantially vertical orientation, and combinations thereof.

5. An eyeglass display comprising:

a) a plurality of fixture portions, each fixture portion having a plurality of sections, each section including:

i) a pair of opposing sidewalls;

ii) a back wall extending between the sidewalls;

iii) a front wall extending between the opposing sidewalls to form a proximal opening, wherein the front wall defines at least one aperture for receiving an eyewear support fixture;

iv) a base wall extending between the opposing sidewalls, the back wall, and the front wall to enclose a distal end of the pod to form a storage space for holding eyewear stock accessible by the proximal opening; and v) a mounting mechanism hingedly attaching the back wall to the fixture portion, wherein each storage space is selectively pivotable away from the fixture portion to provide access to the storage space for restocking the eyewear display; and b) a stationary base with at least three sides for supporting the plurality of fixture portions, each side being adapted and configured to receive the mounting mechanisms so that, in a display position, the plurality of fixture portions are arranged so that at least one of the proximal openings is at least partially blocked by an adjacent one of said fixture portions.

6. A pod for displaying eyewear comprising:

a) opposing sidewalls;

b) a front wall extending between the opposing sidewalls and forming a plurality of mounting apertures;

c) a back wall extending between the opposing sidewalls and opposing the front wall to form a proximal opening;

d) a base wall extending between the opposing sidewalls, the front wall and the back wall to enclose a distal end of the pod to form a storage space for holding eyeglasses accessible by the proximal opening;

e) a mounting mechanism operatively connects to the back wall and having a mounting feature for coupling the pod to a fixture; and f) a plurality of posts for coupling to the plurality of mounting apertures and supporting eyewear by hanging tags, wherein a user can selectively move the storage space from a display position with respect to the mounting mechanism to a restock position by virtue of the mounting mechanism being hingedly attached to the back wall.

7. A pod as recited in claim 6, further comprising a plurality of shelves for coupling to the plurality of mounting apertures and supporting eyewear.

8. A pod as recited in claim 6, further comprising a magnet mounted to the back wall for retaining the mounting mechanism in the display position.

9. An eyeglass display comprising:

a) a base;

b) an elongated pedestal upstanding from the base along an axis and mounted for rotation about the axis; and c) a plurality of pods selectively mounted to the elongated pedestal, each pod including:

i) a first pair of opposing sidewalls;

ii) a second pair of opposing sidewalls extending between the first pair and forming a proximal opening, wherein an inner wall of the second pair is adjacent the elongated pedestal and an outer wall of the second pair forms at least a portion of a periphery of the eyeglass display case, wherein the outer wall defines at least one mounting aperture;

iii) a base wall extending between the first and second pairs to enclose a distal end of the pod to form a storage space for holding eyeglasses accessible by the proximal opening; and iv) a mounting mechanism attached to the inner wall by a hinge and having a mounting feature for coupling the pod to the elongated pedestal, wherein, in a display position, the plurality of pods are adjacent the mounting mechanism so that the proximal opening is at least partially blocked by adjacent pods, and in a restock position, each pod is individually pivoted away from the elongated pedestal to provide access to the storage space.

10. An eyeglass display as recited in claim 9, wherein the at least one mounting aperture is a plurality of outer wall mounting apertures and further comprising three shelves for each pod, each shelf being adapted and configure to selectively mount to the plurality of outer wall mounting apertures and display a pair of glasses on a line perpendicular to an axis of the pedestal.

11. An eyeglass display as recited in claim 9, wherein the at least one mounting aperture is a plurality of outer wall mounting apertures and further comprising three posts for each pod, each post being adapted and configure to selectively mount to the plurality of outer wall mounting apertures and display a pair of glasses on a line parallel to an axis of the pedestal by a hanging tag.

12. An eyeglass display as recited in claim 9, further comprising a magnet mounted to each inner wall for retaining the pod in the display position.

13. A pod for displaying eyewear comprising:

a) opposing sidewalls;

b) a front wall extending between the opposing sidewalls and forming a plurality of mounting apertures;

c) a back wall extending between the opposing sidewalls and opposing the front wall to form a proximal opening;

d) a base wall extending between the opposing sidewalls, the front wall and the back wall to enclose a distal end of the pod to form a storage space for holding eyeglasses accessible by the proximal opening;

e) a mounting mechanism operatively connects to the back wall and having a mounting feature for coupling the pod to a fixture; and f) a plurality of shelves for coupling to the plurality of mounting apertures and supporting eyewear, wherein a user can selectively move the storage space from a display position with respect to the mounting mechanism to a restock position by virtue of the mounting mechanism being hingedly attached to the back wall.

14. A pod as recited in claim 13, further comprising a magnet mounted to the back wall for retaining the mounting mechanism in the display position.

15. A pod for displaying eyewear comprising:

a) opposing sidewalls;

b) a front wall extending between the opposing sidewalls and forming a plurality of mounting apertures;

c) a back wall extending between the opposing sidewalls and opposing the front wall to form a proximal opening;

d) a base wall extending between the opposing sidewalls, the front wall and the back wall to enclose a distal end of the pod to form a storage space for holding eyeglasses accessible by the proximal opening;

e) a mounting mechanism hingedly connects to the back wall and having a mounting feature for coupling the pod to a fixture; and f) a plurality of posts for coupling to the plurality of mounting apertures and supporting eyewear by hanging tags, wherein a user can selectively move the storage space from a display position with respect to the mounting mechanism to a restock position by hingedly rotating the mounting mechanism with respect to the back wall, wherein the plurality of posts are selected from a group consisting of fixtures that present eyeglasses in a substantially horizontal orientation, a substantially vertical orientation, and combinations thereof.

16. A pod as recited in claim 15, further comprising a plurality of shelves for coupling to the plurality of mounting apertures and supporting eyewear.

17. A pod as recited in claim 15, further comprising a magnet mounted to the back wall for retaining the mounting mechanism in the display position.

* * * * *